US009432764B2

(12) United States Patent
Wheeler

(10) Patent No.: US 9,432,764 B2
(45) Date of Patent: Aug. 30, 2016

(54) DYNAMIC ACOUSTIC WAVEGUIDE

(71) Applicant: William Eugene Wheeler, High Ridge, MO (US)

(72) Inventor: William Eugene Wheeler, High Ridge, MO (US)

(73) Assignee: William Eugene Wheeler, Valley Park, MO (US)

( * ) Notice: Subject to any disclaimer, the term of this patent is extended or adjusted under 35 U.S.C. 154(b) by 0 days.

(21) Appl. No.: 14/538,665

(22) Filed: Nov. 11, 2014

(65) Prior Publication Data

US 2015/0129351 A1 May 14, 2015

Related U.S. Application Data

(60) Provisional application No. 61/903,227, filed on Nov. 12, 2013.

(51) Int. Cl.
*H04R 1/28* (2006.01)

(52) U.S. Cl.
CPC ..... *H04R 1/2853* (2013.01); *H04R 1/2803* (2013.01)

(58) Field of Classification Search
CPC H04R 1/2815; H04R 1/2819; H04R 1/2823; H04R 1/2826; H04R 1/2853; H04R 1/2857; H04R 1/347
USPC ..... 181/156; 381/349, 350, 86
See application file for complete search history.

(56) References Cited

U.S. PATENT DOCUMENTS 4,524,846 A * 6/1985 Whitby ..... H04R 1/30 181/147
4,628,528 A 12/1986 Bose
5,105,905 A * 4/1992 Rice ..... H04R 1/345 181/155
5,170,435 A * 12/1992 Rosen ..... B60R 11/0217 181/144
5,193,118 A * 3/1993 Latham-Brown ... B60R 11/0217 381/302
5,446,793 A * 8/1995 Piccaluga ..... H04R 1/323 181/199
5,524,062 A * 6/1996 Oh ..... H04R 1/2842 181/156
5,675,131 A * 10/1997 Saito ..... H04R 5/02 181/141
7,688,992 B2 * 3/2010 Aylward ..... H04R 1/028 381/333
8,130,976 B2 * 3/2012 Linhard ..... B60R 13/0237 381/150
2008/0101646 A1 * 5/2008 Holmi ..... B60R 11/0217 381/389
2012/0219171 A1 * 8/2012 Velican ..... H04R 1/22 381/353
2014/0072162 A1 * 3/2014 Huang ..... H04R 1/2807 381/353

OTHER PUBLICATIONS

Song, "Emission Enhancement of Sound Emitters using an Acoustic Metamaterial Cavity," www.nature.com/scientificreports.com, Nature Publishing Group, Mar. 3, 2014, 6 pages.

* cited by examiner

*Primary Examiner* — Jeremy Luks
(74) *Attorney, Agent, or Firm* — Lewis Rice LLC

(57) ABSTRACT

A loudspeaker and a method of operation which allow for the production and emphasis of extremely low bass tones. The loudspeaker generally is formed from a loudspeaker driver cone of conventional type which is placed in a very small enclosure with two waveguides attached thereto. A smaller balance waveguide is positioned forward of the face of the cone and a larger tuning waveguide is positioned to the side of the cone. The cross-sectional area of the aperture connections of both waveguides to the enclosure are small compared to the cross-sectional area of the loudspeaker driver cone.

16 Claims, 6 Drawing Sheets

DYNAMIC ACOUSTIC WAVEGUIDE

CROSS REFERENCE TO RELATED APPLICATION(S)

This application claims benefit of U.S. Provisional Patent Application Ser. No. 61/903/227, filed Nov. 12, 2013, the entire disclosure of which is herein incorporated by reference.

BACKGROUND

1. Field of the Invention

This disclosure is related to the field of audio acoustics. More specifically, to sound reproduction using an acoustic driver or transducer and a complimentary acoustic system such as an enclosure or housing for the driver to produce a loudspeaker capable of reproducing and emphasizing sub-bass tones.

2. Description of the Related Art

The reproduction of bass tones through audio systems mounted in homes or automobiles is a well-established technology, but it is also recognized that producing low tones, commonly called deep bass or sub-bass, can be extraordinarily difficult. Systems for performing such reproduction which will generally focus on tones of less than 40 Hz, less than 20 Hz, and even down to single digit ranges, generally share a few key features. The primary shared feature is that bass speakers that produce particularly low tones are often very large. In effect, the larger the cone of the speaker, the better able it is to handle lower tones. By extension, such systems are also generally quite expensive.

Sub-bass sounds (and even sub sub-bass or first octave tones) are particularly important in pipe organ music (where a large pipe organ can produce exceedingly low tones potentially into the single digit Hz range and commonly below 20 Hz), certain types of music featuring well played low bass instruments (such as the tuba which can also produce tones well below 20 Hz in the hands of a skilled player), many forms of modern dance club music (where tones of any value can be produced electronically and particularly low tones are commonly used to provide for "feel" to the music), and musical works that utilize uncommon instrumentation (for example the cannons in Pyotr Tchaikovsky's 1812 Overture).

It is commonly accepted that tones below 20 Hz are not actually capable of being heard by a human being, however, that does not mean these tones are unimportant in music reproduction. For some types of audio enthusiasts, the production of bass tones is a physical thing. The notes are more felt than heard, and the purpose of their reproduction is not necessarily as much to provide for audio depth and rhythm, as it is to provide raw force. This can be common in dance clubs where a pulsing beat of music is more felt than heard in the club with the bass literally vibrating structures and bodies. This type of physical bass "thump" is also commonly used in mobile audio applications where production of such tones can serve to shake the car providing both feel and potentially a desirable "rattle" from the cars body. While many audio enthusiasts will shun this type of audio reproduction as making the bass of the music heavy or over-emphasized (essentially contending that the music is distorted), there is a clear group which both enjoys this sensation, and there is a need for it in certain types of recorded music to accurately reproduce not just the music's sound but its feel.

Deep bass production can also be very important in areas other than in music. In movies for example, deep, potentially inaudible bass reproduction can be necessary to produce mood. The movie Jurassic Park includes a particularly well known scene where steps of an approaching Tyrannosaurs Rex are felt (and seen in a rippling cup of water) rather than heard. Similarly, images of scenes of earthquakes or natural disasters can be emphasized by providing an audio track with a physical component (where the shaking is quite literally felt) in addition to a sonic one.

There exist some acoustic waveguides and audio transmission lines that enhance or extend the range of a given transducer. One such device is shown in U.S. Pat. No. 4,628,528. In this device, improved bass reproduction is provided through the use of two acoustic waveguides coupled to the front and rear of a loudspeaker driver. The system utilizes mounting the driver on an acoustic baffle to isolate forward and rearward deflections of the driver cone. Forward deflections are channeled through an aperture of substantially the same diameter as the cone through a short acoustic waveguide, while rearward deflections are directed through a shorter waveguide (3 time the length of the forward one) to produce cavity resonance producing lower tones. These systems, however, are not generally expected to produce particularly low sub-bass tones (e.g. below 40 Hz) with any substantial volume.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein is an acoustic waveguide and loudspeaker system which achieves a greater range and response particularly at the low end of the audio spectrum (e.g. less than 60 Hz, but particularly less than 40 Hz, as well as tones in the sub 20 Hz and sub 10 Hz ranges) than prior acoustic waveguides. While waveguides and transmission lines of the prior art may claim quarter wavelength resonance, it is not entirely exclusive. Multiple points of resonance including driver resonance, open ended half wavelength resonance of the entire waveguide or any of its vents or ports is often referred to. Closed/open or quarter wavelength resonance of any vent or port originating from the drivers enclosure are all points of resonance that have varying degrees of impact upon system output. Quarter wavelength resonance of the largest vent or port represents the lowest point of resonance. The strength of this point of resonance can be affected by the manner in which the transducer is coupled to the port. Additionally the low end cut off can be affected by this coupling as well. By strengthening the coupling to the primary or dominant port, increased efficiency, stronger quarter wavelength resonance and a lower/deeper low end cut off can all be achieved.

A loudspeaker and a method of operation which allow for the production and emphasis of extremely low bass tones is provided herein. The loudspeaker generally is formed from a loudspeaker driver cone of conventional type which is placed in a very small enclosure with two waveguides attached thereto. A smaller balance waveguide is positioned forward of the face of the cone and a larger tuning waveguide is positioned to the side of the cone. The cross-sectional area of the aperture connections of both waveguides to the enclosure are small compared to the cross-sectional area of the loudspeaker driver cone.

There is described herein, among other things, a loudspeaker comprising: an enclosure enclosing a loudspeaker driver cone having a cross-sectional area at a forward face; a tuning waveguide coupled to said enclosure at a position to a side of the loudspeaker driver cone; and a balance waveguide coupled to said enclosure at said forward face of said loudspeaker driver cone, said balance waveguide being shorter than said tuning waveguide; wherein said tuning waveguide includes a greater volume of air than said balance waveguide which in turn includes a greater volume of air than said enclosure; and wherein said coupling of said balance waveguide to said enclosure has a cross-sectional area smaller than said cross-sectional area of said forward face of said driver cone.

In an embodiment of the loudspeaker, the balance waveguide is less than 25% the length of said tuning waveguide.

In an embodiment of the loudspeaker, the balance waveguide is less than 50% the length of said tuning waveguide.

In an embodiment of the loudspeaker, the tuning waveguide includes at least 2 times the volume of air of said balance waveguide.

In an embodiment of the loudspeaker, the tuning waveguide includes at least 10 times the volume of air of said balance waveguide.

In an embodiment of the loudspeaker, the volume of air in said tuning waveguide is at least 10 times the volume of air in said enclosure.

In an embodiment of the loudspeaker, the volume of air in said balance waveguide is at least 2.5 times the volume of air in said enclosure.

In an embodiment of the loudspeaker, the coupling of said tuning waveguide to said enclosure has a cross-sectional area generally the same as said cross-sectional area of said coupling of said balance waveguide to said enclosure.

In an embodiment of the loudspeaker, the cross-sectional area of said coupling of said balance waveguide to said enclosure is less than 75% of said cross-sectional area of said forward face of said driver cone.

In an embodiment of the loudspeaker, the cross-sectional area of said coupling of said balance waveguide to said enclosure is less than 50% of said cross-sectional area of said forward face of said driver cone.

In an embodiment of the loudspeaker, the cross-sectional area of said coupling of said balance waveguide to said enclosure is less than 25% of said cross-sectional area of said forward face of said driver cone.

In an embodiment of the loudspeaker, the said cross-sectional area of said coupling of said balance waveguide to said enclosure is between 25% and 50%, inclusive, of said cross-sectional area of said forward face of said driver cone.

There is also described herein, a method of producing a sound wave, the method comprising: providing: an enclosure enclosing a loudspeaker driver cone having a cross-sectional area at a forward face; a tuning waveguide coupled to said enclosure at a position to a side of said loudspeaker driver cone by an aperture having a cross-sectional area less than said cross-sectional area of said forward face; and a balance waveguide coupled to said enclosure at said forward face of said loudspeaker driver cone by an aperture having a cross-sectional area less than said cross-sectional area of said forward face; driving said driver cone to produce a sound wave at said forward face; directing at least a portion of said sound wave into both said tuning waveguide and said balance waveguide in a manner that said sound wave upon exiting said tuning waveguide and said balance waveguide is less than 60 Hz, less than 40 Hz, less than 20 Hz, or less than 10 Hz depending on embodiment.

DESCRIPTION OF THE PREFERRED EMBODIMENT(S)

Using the principles of resonance and a special method of acoustic coupling a dynamic acoustic waveguide of the present disclosure greatly improves the low end response and efficiency of acoustic drivers. As discussed in more detail in the FIGS, an embodiment of a dynamic acoustic waveguide will generally comprise a driver enclosure of much smaller proportions than what is considered to be standard, an overriding vent or port that is much larger in volume than the drivers enclosure, and a shorter vent or port that acts as both a low pass filter and to provide equilibrium to the loads on the front and rear of the drivers cone. Both vents or ports generally have a cross-sectional area that is markedly smaller than that of the driver.

Figure 1:
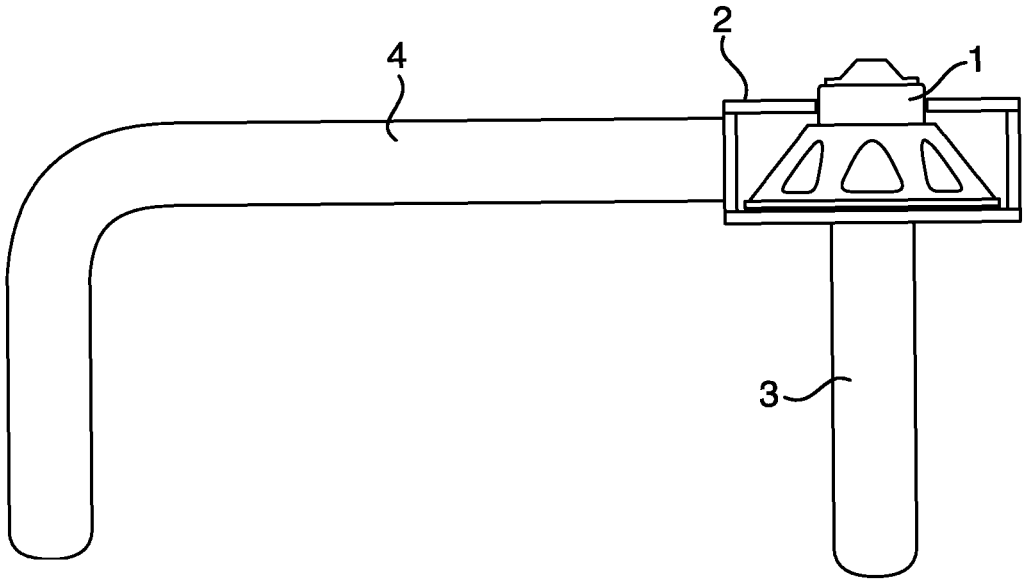
FIG. 1 shows a 2-dimensional concept drawing for the purpose of explaining a theory of operation of an embodiment of a dynamic acoustic waveguide.

FIG. 1 provides a general concept drawing of an embodiment of an acoustic waveguide to provide amplified low tones. FIG. 1 shows a loudspeaker driver cone (1) (generally from between 10" to 20" in diameter and intended to produce bass tones but this is by no means required) of generally conventional construction and of a type well known to those of ordinary skill in the art in a small enclosure (20) with an attached large port or vent that from this point shall be referred to as the tuning waveguide (8) and an attached smaller port or vent that from this point shall be referred to as the balance waveguide (7).

The balance waveguide (7), in an embodiment, will preferably have a length of 50%, 33%, 25%, or less the length of the tuning waveguide (8), depending on embodiment, however, this is by no means required. Similarly, the volume of air in the tuning waveguide (8) will generally be significantly greater than that of the balance waveguide (7). In an embodiment, this will be a volume around 2 times, 4 times, 10 times, or more than that of the balance waveguide (7). However, in alternative embodiments, this is by no means required. Specific values for both relative volumes and lengths would be selected by one of ordinary skill in the art within these ranges based on the particular tones and ranges the loudspeaker is intended to operate within and reproduce.

The tuning waveguide (8) having the largest volume and therefore the largest mass air movement capability is considered dominant and generally has the greatest impact on the dynamic range of the system. The enclosure (20) is also extremely confined and, in the depicted embodiment, is only as large as is necessary to enclose the cone of the driver and includes an air volume less than that of either the tuning waveguide (8) or balance waveguide (7). As shown in the FIGS, the enclosure (20) is purposefully rendered even smaller by positioning the magnet of the driver (1) outside the volume of the enclosure (20). This allows for the enclosure to be of general size of a parallelepiped having two dimensions close to or equal to the diameter of the forward face of the cone (1) and a third dimension which is less than the depth of the cone (1). In an embodiment, the volume of empty air in the enclosure (20) (the volume of air not taken up by the cone (1) itself and associated electronics attached thereto) is significantly less than the volume of air in either waveguide (7) or (8). In an embodiment, the volume of the empty air in enclosure (20) is about 1/10 of the volume of the tuning waveguide (8) or less. In yet another embodiment, the volume of the balance waveguide (7) is at least 2.5 times that of the enclosure (20). To reduce the volume of the air in a bigger formed enclosure (20), the volume of the enclosure (20) may be at least partially occupied by baffling or other material.

Further, the tuning waveguide (8) is connected to the side of the driver cone (1) and is not directly behind the driver (1). Instead, the rear of the driver cone (1) is actually positioned outside the enclosure (20). The relationship between the tuning waveguide (8) and the enclosure (20) is such that the enclosure (20) becomes secondary in response to driver output and that an intended acoustic mismatch between them causes an exaggerated quarter wavelength resonance from the tuning waveguide (8). Again the volume of the tuning waveguide (8) is about 10 times or more that of the enclosure (20) in an embodiment, but that is by no means required.

As should be apparent, the balance waveguide (7) in the depicted embodiment of FIG. 1 is positioned in front of the transducer or driver (1) while the larger tuning waveguide (8) is positioned to the side of the driver (1). Further, both the balance waveguide (7) and the tuning waveguide (8) will have a cross-sectional area substantially smaller than that of the driver (1) meaning the apertures (11) and (12) are much smaller than the cross-sectional area of the forward face of the cone (1). It is generally preferred that the cross-sectional area of both the aperture (11) and the aperture (12) be similar or the same.

Depending on embodiment, the aperture (11) may have a cross-sectional area of less than 75% of that of the cross-sectional area of the forward face of the driver (1). In alternative embodiments, the aperture (11) may have a cross-sectional area less than 50%, less than 25%, or between 25% and 50%, inclusive, of the cross-sectional area of the driver (1) forward face. The remaining area of the forward face of the driver (1) is positioned against an acoustical baffle forming a portion of the acoustic guide and a base of the enclosure (20).

The relatively smaller enclosure (20) volume may contribute to driver accuracy. The intended mismatch between the tuning waveguide (8) and driver enclosure (20) volume provides an efficient method of coupling between the driver (1) and tuning waveguide (8). This mismatched coupling is the result of the tuning waveguide's (8) mass air movement overriding that of the enclosure (20). The tuning waveguide's (8) dominance coupled with the small enclosure's (20) volume creates an extreme non-compliance that allows direct and efficient communication between the driver (1) and the tuning waveguide (8). The balance waveguide (7) provides equilibrium between the loads on the front and rear of the driver cone (1) improving overall efficiency. The balance waveguide (7) being shorter in length than the tuning waveguide (8) further acts as a low pass filter.

Figure 2:
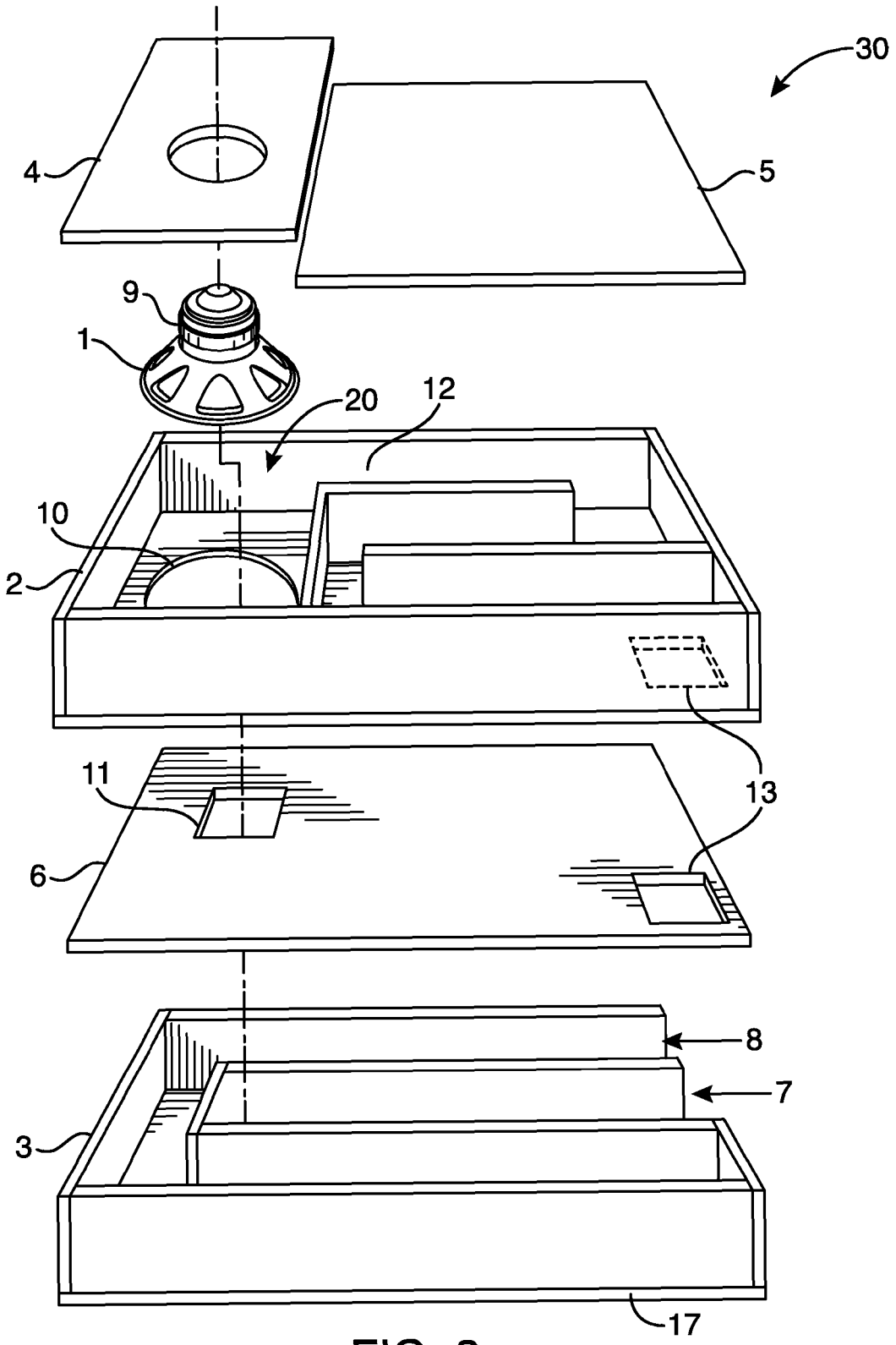
FIG. 2 shows a 3-dimensional exploded drawing of an embodiment of a loudspeaker utilizing a dynamic acoustic waveguide of the present invention.

FIG. 2 shows an exploded 3-dimensional drawing of an embodiment of an acoustic waveguide utilizing the principles of FIG. 1. In FIG. 2, the waveguide is in the form of a generally rectilinear cabinet (30). The cabinet (30) could be constructed of a wide variety of materials including; particle board, Medium Density Fiberboard (MDF), plywood, fiberglass, or any other suitable material. In an embodiment, the cabinet (30) will be constructed of an acoustic metamaterial such as, but not limited to those, discussed in Song et al. "Emission Enhancement of Sound Emitters using an Acoustic Metamaterial Cavity" *Scientific Reports* (3 Mar. 2014)—available at www.nature.com/srep/2014/140303/srep04165/full/srep04165.html, the entire disclosure of which is herein incorporated by reference. The cabinet is generally constructed as two "stacks" which are arranged to be positioned on top of each other.

Figure 5:
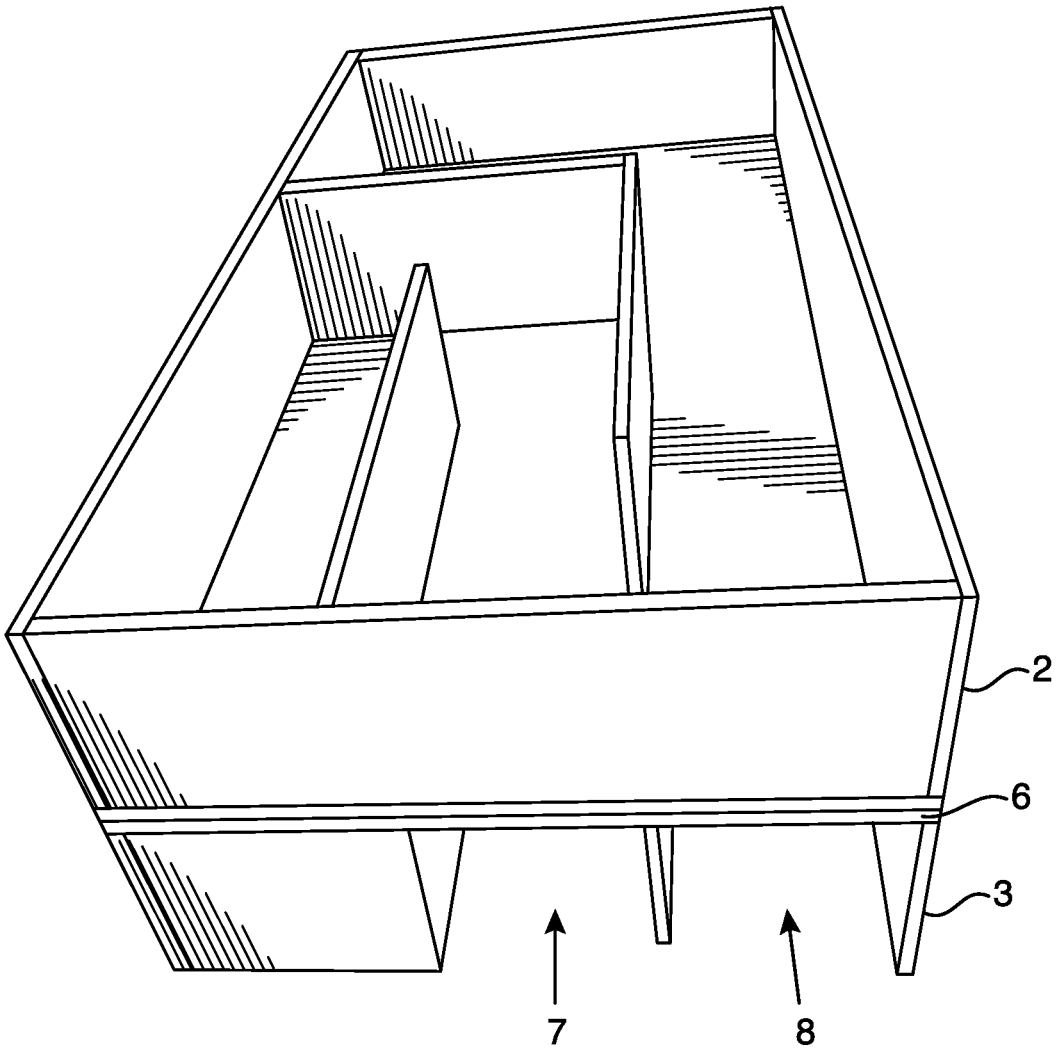
FIG. 5 shows the upper stack of FIG. 3 connected to the lower stack of FIG. 4.

The driver (1) is attached to the main body's upper stack (2). The main body's upper stack (2) is attached to the main body's lower stack cover (6) as is best shown in FIG. 5. The lower cover is then attached to the lower stack (3). The lower stack cover (6) encloses the lower stacks (3) portion of the tuning waveguide (8) and the balance waveguide (7). The upper stack (2) has two covers, One cover (4) encloses the driver and has a circular hole to allow the driver's (1) magnet(s) and pole piece to slide through it. The other cover (5) encloses the top stacks (2) portion of the tuning waveguide (8)

The driver (1) attaches face down over the top of a circular hole (10) in the main body's upper stack (2) to provide relief for driver (1) cone excursion. The driver (1) may have a compressible foam or other suitable material (9) fixed to the perimeter of its magnet(s) structure as to provide a seal between the driver (1) and the driver cover (4). The driver (1) faces the relief hole (10) and produces sound that travels through the relief hole (10) and through the balance waveguide aperture (11) into the balance waveguide (7) and eventually to the outside of the cabinet. The rear side of the driver (1) produces sound that enters through the tuning waveguide aperture (12) into the upper portion of the tuning waveguide (8) through the upper and lower tuning waveguide couplings (13) into the lower portion of the tuning waveguide (8) and eventually to the outside of the cabinet.

Figure 3:
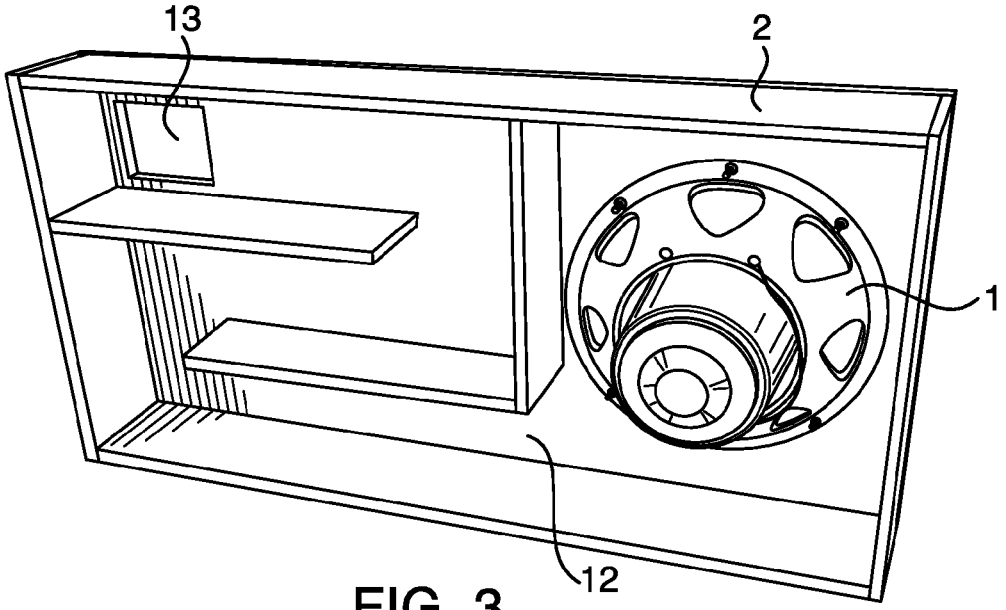
FIG. 3 shows a top view of the upper stack of the loudspeaker of FIG. 2.

FIGS. 3-8 provide drawings of an embodiment constructed according to the design of FIG. 2 in various states of assembly. FIG. 3 provides a drawing of the upper stack (2) as viewed from above with a Diamond D3 subwoofer (1) installed and without the covers (4) and (5). The tuning waveguide aperture (12) and the tuning waveguide coupling (13) are visible.

Figure 4:
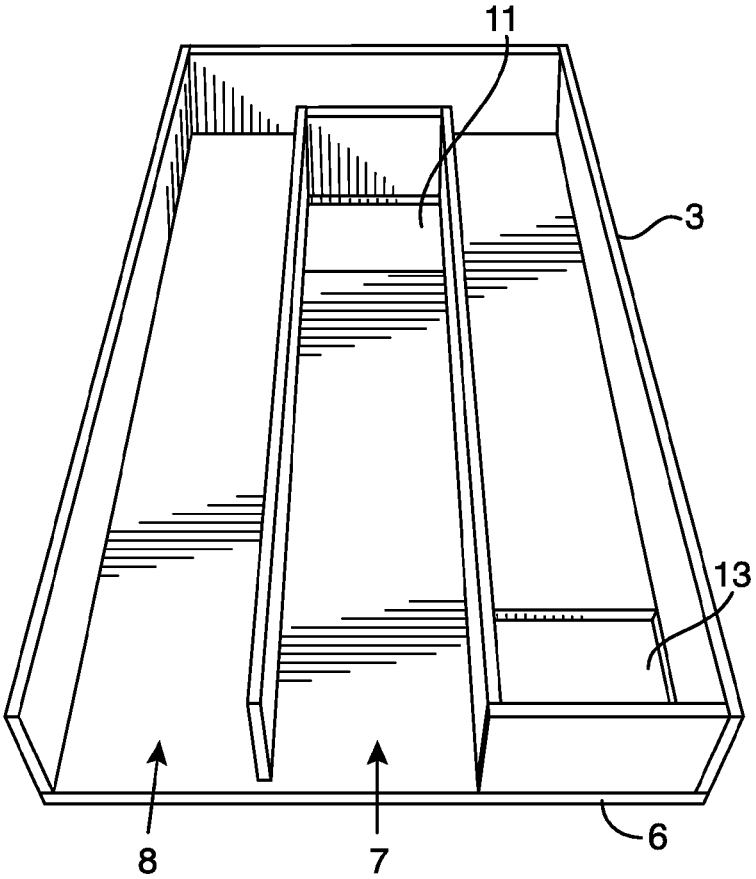
FIG. 4 shows a bottom view of the lower stack and cover of the loudspeaker of FIG. 2.

FIG. 4 is a drawing of the lower stack (3) and cover (6) viewed from below showing the balance waveguide aperture (11) the balance waveguide (7) the tuning waveguide (8) and the tuning waveguide coupling (13). The base (17) is not shown for clarity in this drawing.

FIG. 5 is a drawing of the upper stack (2) connected to the lower stack (3) via the lower stack cover (6) as viewed from above showing the balance waveguide (7) and the tuning waveguide (8). The driver cone (1) is not present in this drawing for clarity.

Figure 6:
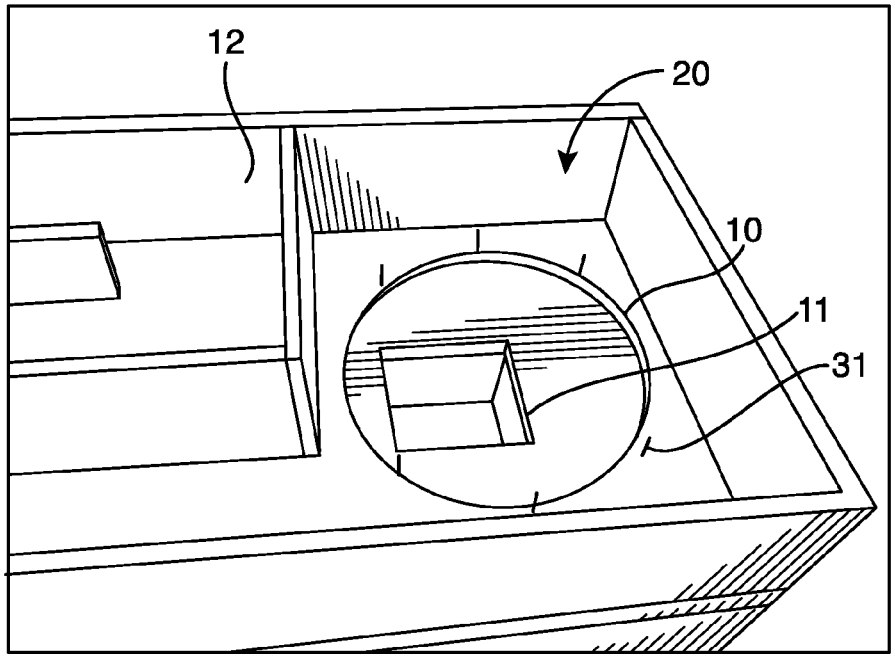
FIG. 6 shows the embodiment of FIG. 5 from an alternative angle.

FIG. 6, shows the embodiment of FIG. 5 from a different angle. FIG. 6 shows the enclosure (20) with the balance waveguide aperture (10) the driver cone (1) relief hole (10) into which the transducer (1) would normally be positioned. As can be seen, the aperture (10) is significantly smaller than the hole (10). There are also included anchor studs (31) for securing the transducer in the hole (10). The tuning waveguide aperture (12) is also visible.

Figure 7:
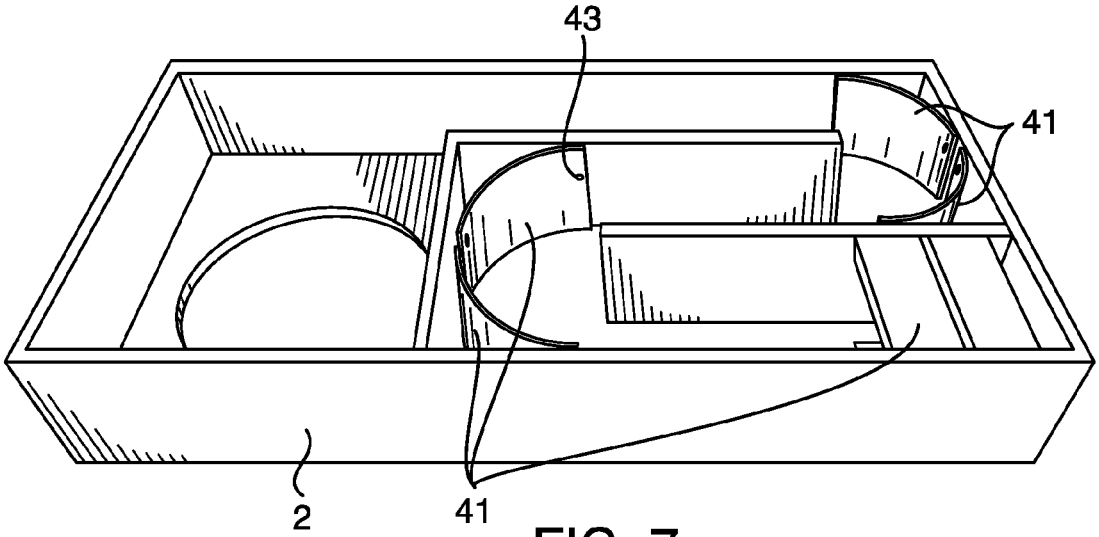
FIG. 7 shows an embodiment of an upper stack of a loudspeaker which includes rounded guide pieces in the waveguides.

FIG. 7 is a drawing showing the upper stack (2) with guide pieces (41) installed therein. Guide pieces (41) may be used to smooth hard corners in the various ports to better direct the acoustic waves through the waveguide and around bends. The guide pieces (41) in the depicted embodiment comprise cardboard surfaces which have been arranged into smooth curves. In this particular embodiment, the guide pieces (41) comprises a Sonotube™ which has been quartered into 90 degree segments and fastened to the main body using wood screws (43). The lower stack (3) may also include guide pieces (41) therein.

Figure 8:
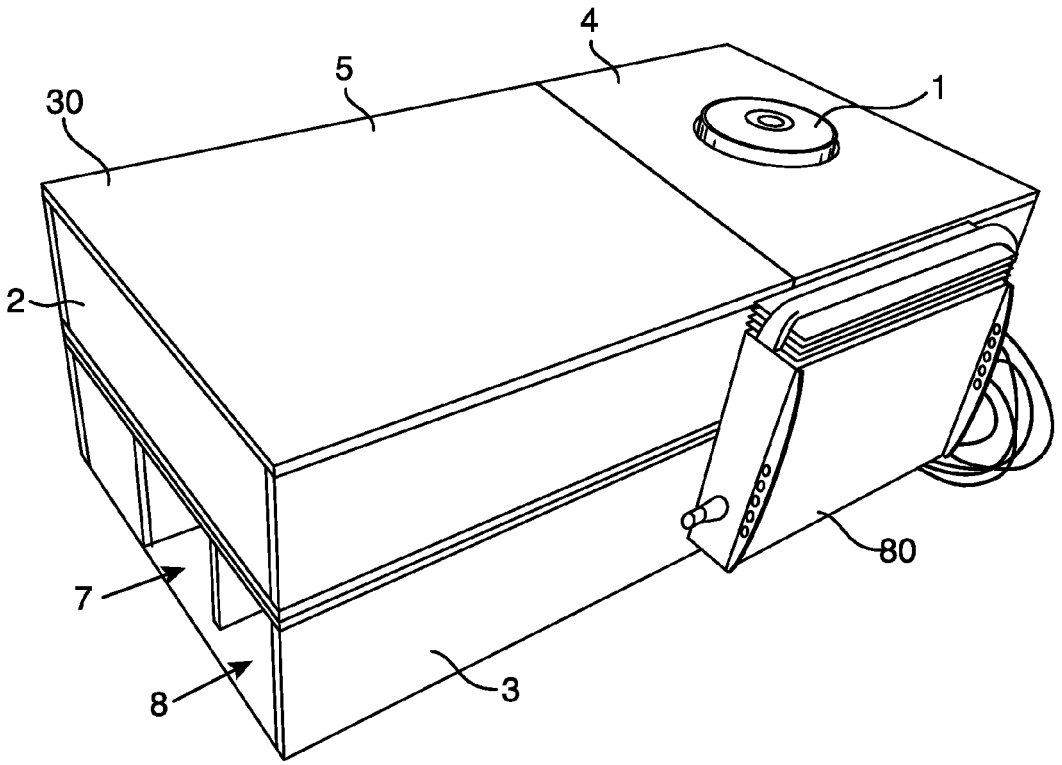
FIG. 8 shows an embodiment of a loudspeaker in the trunk of a vehicle.

FIG. 8 provides a drawing of the completed loudspeaker installed in the trunk of a vehicle. The upper and lower stacks (2) and (3) are visible as are the upper stack's (2) tuning waveguide cover (5), the diamond D3 subwoofer (1) of FIG. 3, the drivers enclosure cover (4), the tuning waveguide (8), and the balance waveguide (7). The cabinet (30) has attached thereto an optional audio amplifier (80) which may be used to boost signal into the speaker (1). While FIG. 8 shows the device without any finishing, further finishing to the cabinet (30) such as upholstering or veneering as those things are understood by those of ordinary skill in the art may be carried out in some embodiments.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A loudspeaker comprising:

an enclosure having a back side and an opposing front side, said enclosure enclosing a loudspeaker driver cone having a cross-sectional area at a forward face, said loudspeaker driver cone being disposed in said enclosure such that said cross-sectional area is disposed concentrically with said opening and is generally flush with said front side;

a turning waveguide coupled to said enclosure at a position lateral to the loudspeaker driver cone, said turning waveguide extending a from said enclosure in a direction generally parallel to the plane of said cross-sectional area; and a balance waveguide coupled to said front side of said enclosure at said forward face of said loudspeaker driver cone generally coaxially with said cross-sectional area, said balance waveguide being shorter than said tuning waveguide;

wherein said tuning waveguide includes a greater volume of air than said balance waveguide which in turn includes a greater volume of air than said enclosure; and wherein said coupling of said balance waveguide to said enclosure has a cross-sectional area smaller than said cross-sectional area of said forward face of said driver cone.

2. The loudspeaker of claim 1 wherein said balance waveguide is less than 50% the length of said tuning waveguide.

3. The loudspeaker of claim 1 wherein said balance waveguide is less than 25% the length of said tuning waveguide.

4. The loudspeaker of claim 1 wherein said tuning waveguide includes at least 2 times the volume of air of said balance waveguide.

5. The loudspeaker of claim 1 wherein said tuning waveguide includes at least 10 times the volume of air of said balance waveguide.

6. The loudspeaker of claim 1 wherein said volume of air in said tuning waveguide is at least 10 times the volume of air in said enclosure.

7. The loudspeaker of claim I wherein said volume of air in said balance waveguide is at least 2.5 times the volume of air in said enclosure.

8. The loudspeaker of claim 1 wherein said coupling of said tuning waveguide to said enclosure has a cross-sectional area generally the same as said cross-sectional area of said coupling of said balance waveguide to said enclosure.

9. The loudspeaker of claim 1 wherein said cross-sectional area of said coupling of said balance waveguide to said enclosure is less than 75% of said cross-sectional area of said forward face of said driver cone.

10. The loudspeaker of claim 7 wherein said cross-sectional area of said coupling of said balance waveguide to said enclosure is less than 50% of said cross-sectional area of said forward face of said driver cone.

11. The loudspeaker of claim 8 wherein said cross-sectional area of said coupling of said balance waveguide to said enclosure is less than 25% of said cross-sectional area of said forward face of said driver cone.

12. The loudspeaker of claim 1 wherein said cross-sectional area of said coupling of said balance waveguide to said enclosure is between 25% and 50%, inclusive, of said cross-sectional area of said forward face of said driver cone.

13. A method of producing a sound wave of less than 60 Hz, the method comprising:

providing:

an enclosure having a back side and an opposing front side, said enclosure enclosing a loudspeaker driver cone having a cross-sectional area at a forward face, said loudspeaker driver cone being disposed in said enclosure such that said cross-sectional area is disposed concentrically with said opening and is generally flush with said front side;

a tuning waveguide coupled to said enclosure at a position lateral to said loudspeaker driver cone by an aperture having a cross-sectional area less than said cross-sectional area of said forward face, said tuning waveguide extending from said enclosure in a direction generally parallel to the plane of said cross-sectional area; and a balance waveguide coupled to said enclosure at said forward face of said loudspeaker driver cone generally coaxially with said cross-sectional area by an aperture having a cross-sectional area less than said cross-sectional area of said forward face;

driving said driver cone to produce a sound wave at said forward face;

directing at least a portion of said sound wave into both said tuning waveguide and said balance waveguide in a manner that said sound wave upon exiting said tuning waveguide and said balance waveguide is less than 60 Hz.

14. The method of claim 13 wherein said sound wave upon exiting said tuning waveguide and said balance waveguide is less than 40 Hz.

15. The method of claim 13 wherein said sound wave upon exiting said tuning waveguide and said balance waveguide is less than 20 Hz.

16. The method of claim 13 wherein said sound wave upon exiting said tuning waveguide and said balance waveguide is less than 10 Hz.

* * * * *